US006390157B1

(12) United States Patent
Moogdaharn et al.

(10) Patent No.: US 6,390,157 B1
(45) Date of Patent: May 21, 2002

(54) MECHANIZED VANISHING OIL REFILL SYSTEM AND METHOD

(75) Inventors: Chalor Moogdaharn, Nakorn Sawan; Watcharin Pinlam, Pathumthanee; Youthachai Bupparit, Nonthaburi, all of (TH)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/699,695

(22) Filed: Oct. 30, 2000

(51) Int. Cl.[7] ..... B65B 1/04
(52) U.S. Cl. ..... 141/383; 141/382; 141/231
(58) Field of Search ..... 141/231, 382, 141/383; 222/608, 526, 527; 184/1.5

(56) References Cited

U.S. PATENT DOCUMENTS

| | | | | |
|---|---|---|---|---|
| 2,059,704 | A | * 11/1936 | Miller | |
| 3,288,169 | A | * 11/1966 | Moss | |
| 3,920,056 | A | 11/1975 | Piecuch | |
| 4,009,734 | A | * 3/1977 | Sullivan | |
| 4,144,915 | A | 3/1979 | Henderson | |
| 4,354,574 | A | * 10/1982 | Kieber | 184/1.5 |
| 4,924,221 | A | * 5/1990 | Filippone | |
| 4,988,020 | A | 1/1991 | Webb | |
| 5,154,314 | A | * 10/1992 | Van Wormer | 141/231 |
| 5,154,317 | A | * 10/1992 | Roppolo, III | 222/608 |
| 5,224,379 | A | * 7/1993 | Koebernik et al. | |
| 5,230,374 | A | 7/1993 | Dawson et al. | |
| 5,344,075 | A | * 9/1994 | Springer et al. | 239/70 |
| 5,878,767 | A | 3/1999 | Etling et al. | |
| 5,900,546 | A | * 5/1999 | Wilkins | |
| 5,906,226 | A | * 5/1999 | Goodman | |
| 5,947,372 | A | * 9/1999 | Tiernan | |
| 5,964,412 | A | * 10/1999 | Thomas | 239/195 |
| 6,049,658 | A | * 4/2000 | Schave et al. | |

FOREIGN PATENT DOCUMENTS

| | | | |
|---|---|---|---|
| FR | 2641252 A1 | * | 7/1990 |
| JP | 06048494 A | * | 2/1994 |

* cited by examiner

*Primary Examiner*—Gregory L. Huson
*Assistant Examiner*—Khoa Huynh
(74) *Attorney, Agent, or Firm*—Eschweiler & Associates, LLC

(57) ABSTRACT

The present invention relates to a portable lubricant replenishing system for an industrial machine and comprises a battery operated pump for dispensing the lubricant to the machine. The lubricant replenishing system further comprises a retractable tube coupled with a specially configured nozzle to secure to a lubricant reservoir of the machine. The lubricant replenishing system further comprises a control module adapted to operate the pump and display a system status. The present invention also relates to a method of replenishing one or multiple industrial machines with the portable lubricant replenishing system. The method further comprises a robot and a guided vehicle system enabling the method to be operable manually or fully automated.

9 Claims, 11 Drawing Sheets

MECHANIZED VANISHING OIL REFILL SYSTEM AND METHOD

FIELD OF THE INVENTION

The present invention relates generally to lubricants, and more particularly to systems and methods for replenishing lubricants in industrial machines.

BACKGROUND OF THE INVENTION

Today, most integrated circuits (ICs) are made of silicon. The first step from silicon to circuit is the creation of a pure, single-crystal cylinder or ingot of silicon six to eight inches in diameter. These cylinders are sliced into thin, highly polished wafers less than one-fortieth of an inch thick. The wafers are then exposed to a multiple-step photolithography process that is repeated once for each mask required by the circuit. Each mask defines different parts of a transistor, capacitor, resistor, or connector composing the complete integrated circuit and defines the circuitry pattern for each layer on which the device is fabricated.

While still on the wafer, every integrated circuit is tested. Subsequently, functional and nonfunctional chips are identified and mapped into a computer data file. A diamond saw then cuts the wafer into individual chips; and nonfunctional chips are discarded while the rest are sent on to be assembled into plastic or other type packages. Next, the chips are mounted on to lead frames. Thin gold or aluminum wires are used to connect the bonding pads on the chip to the frames to create the electrical path between the die and lead fingers. During plastic type encapsulation, lead frames are placed onto mold plates and heated. Molten plastic material is pressed around each die to form its individual package. The mold is opened, and the lead frames are pressed out and cleaned.

Electroplating is the next process. Here, the encapsulated lead frames are charged while submerged in a tin/lead solution. The tin/lead ions are attracted to the electrically charged leads to create a uniform plated deposit, which increases conductivity and provides a clean consistent surface for surface mount applications. In a trim and form operation, lead frames are loaded into trim and form machines where the leads are formed step by step until individual chips are severed from the frames. The chips are then put into anti-static tubes for handling and transportation to the test area for final testing. The completed packages are then inspected, sealed, and marked with special ink to indicate product type, package code, and speed. The finished goods area ships the chips to computer peripheral, telecommunications, and transportation customers throughout the world.

In one of the final steps in manufacturing an IC, the trim and form process, a trim and form machine is employed. Vanishing oil is typically used in these machines to facilitate a clean die release of the IC leads from the cutting and bending tools of the machines. The advantages of this lubricant over others are that it is easily applied, easily removed and does not leave substantial residue or staining on the chip. The lubricant generally dries in one to four hours. Therefore, the properties of this lubricant require that it be replenished regularly.

A current method of replenishing the vanishing oil in trim/form machines is depicted in prior art FIGS. 1*a* and 1*b*, and designated at reference numerals 10 and 10'; respectively. This method requires an operator to pour the lubricant from a hand held container 20 directly into the lubricant reservoir 30 of the machine 40. This tank or reservoir 30 is typically located well above shoulder height 50. Lifting the container 20, and pouring the lubricant in this manner generally is awkward and inefficient. This current system 10' may lead to overfilling and/or spilling of the lubricant. It is difficult to control the flow of the lubricant when using a hand held container to pour the lubricant at a level above shoulder height 50. This is especially true when the container is full and of considerable weight. Furthermore, the container must be refilled regularly, thereby decreasing productivity. Therefore, a system and method for improving the efficiency and safety of lubricant replenishment in industrial machines is needed.

SUMMARY OF THE INVENTION

The present invention relates to a system and method for efficiently and safely replenishing a lubricant in an industrial machine.

According to the present invention, a lubricant replenishing system and a method of replenishing a lubricant in an industrial machine using such system is disclosed. The lubricant replenishing system comprises an assembly of a battery operated pump, battery, battery charger, control module tube, and nozzle; all mounted together with a lubricant storage tank on a cart, to replenish lubricant in lubricant reservoirs of industrial machines. The lubricant replenishing system is easily portable and user friendly. Since the system replaces the laborious task of using a hand held container to replenish lubricant reservoirs with a portable, mechanized system, the present invention improves the speed, accuracy, and safety of replenishing lubricant reservoirs, thus, overcoming the limitations and shortcomings of the prior art.

According to one aspect of the invention, the lubricant replenishing system comprises a cart to hold and to transport the system components. The cart is easily portable, which enables the operator to easily position and navigate the system from machine to machine. The cart may also be programmed to follow a preset path to position and navigate itself. This may be accomplished by way of tracks, wires, sensors, or similar means. A control module may also be used to monitor and operate the movement of the cart.

According to another aspect of the invention. a lubricant storage tank is coupled with the cart. The storage tank contains an amount of lubricant which allows the system to replenish a machine multiple times. The storage tank may be coupled with a sensing device to monitor a level of lubricant remaining in the tank. When the lubricant level falls below a predetermined level, the sensing device will communicate to the control module, which will signal an operator to refill the storage tank. A similar sensing device may be coupled with the machine or lubricant replenishing system to monitor a level of lubricant in the lubricant reservoir of the machine.

According to yet another aspect of the invention, a dispensing tube is utilized to direct the lubricant from the storage tank to a lubricant reservoir of a machine. The dispensing tube may be plastic or any other flexible material which does not interfere with the properties of the lubricant. The tube may be retractable so as to provide a way of neatly storing the tube when not in use. This will prevent potential tripping hazards and tangling.

According to another aspect of the invention, the dispensing tube is coupled with a nozzle. The nozzle is configured to secure to a lubricant reservoir of a machine. The nozzle may be hook shaped or coupled with a fastening or grasping mechanism. The configured nozzle will free an operator's hands to perform other functions, such as operating the control module.

According to still another aspect of the invention, a pump is coupled with the dispensing tube and operable to selectively dispense lubricant to the lubricant reservoir. The pump may be battery operated to remove the need for an electric wire connection to a power supply. The lubricant replenishing system may also comprise a battery charger to recharge the battery when the battery falls below a predetermined energy level. Again, the control module may be used to monitor and operate the pump, battery, and battery charger.

According to another aspect of the invention, a robot may be included in the system to perform functions such as, securing and detaching the nozzle to and from the lubricant reservoir, operating the control module, and similar functions.

According to another aspect of the invention, methods for replenishing a lubricant in an industrial machine and in multiple industrial machines are provided. The method includes moving the lubricant replenishing system to an industrial machine and dispensing the lubricant into the lubricant reservoir. The system may be controlled by a control module. The method may further include automation to minimize human interaction and, thereby, maximize productivity.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention will become apparent from the following detailed description of the invention when considered in conjunction with the drawings.

DETAILED DESCRIPTION OF THE INVENTION

Figure 1A:
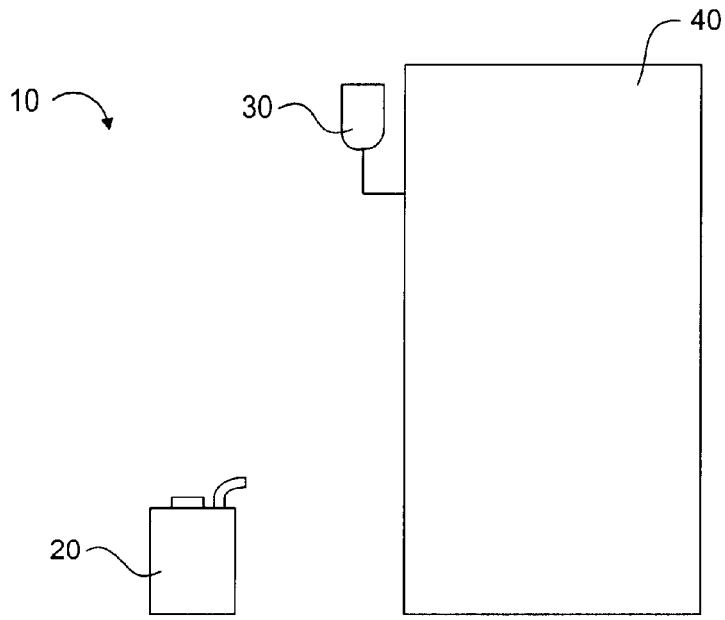
FIG. 1a (PRIOR ART)
FIG. 1*a* is a prior art front view of a lubricant replenishing system employed in trim and form machines.
Figure 1B:
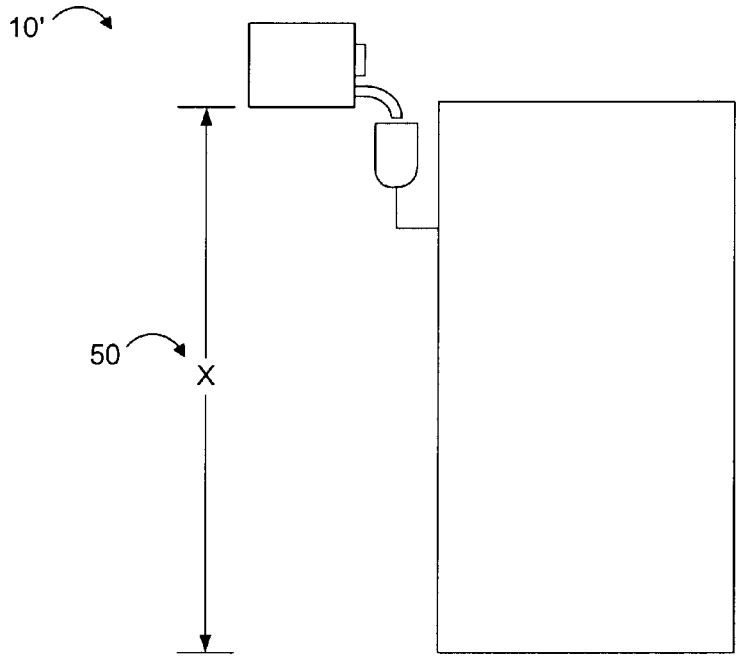
FIG. 1b (PRIOR ART)
FIG. 1*b* is a prior art front view of lubricant replenishing system employed in trim and form machines.

The following is a detailed description of the present invention made in conjunction with the attached figures, wherein like reference numerals will refer to like elements throughout. The present invention is directed towards a system and method of replenishing machine lubricants in industrial machines. The lubricant replenishing system may include a portable cart to transport the system easily from machine to machine. The cart may include a storage tank to contain the machine lubricant. Using this system allows an operator to efficiently and safely replenish machine lubricants in industrial machines. This system may be manually operated, fully automated, or some combination of the two, as may be desired.

Figure 2:
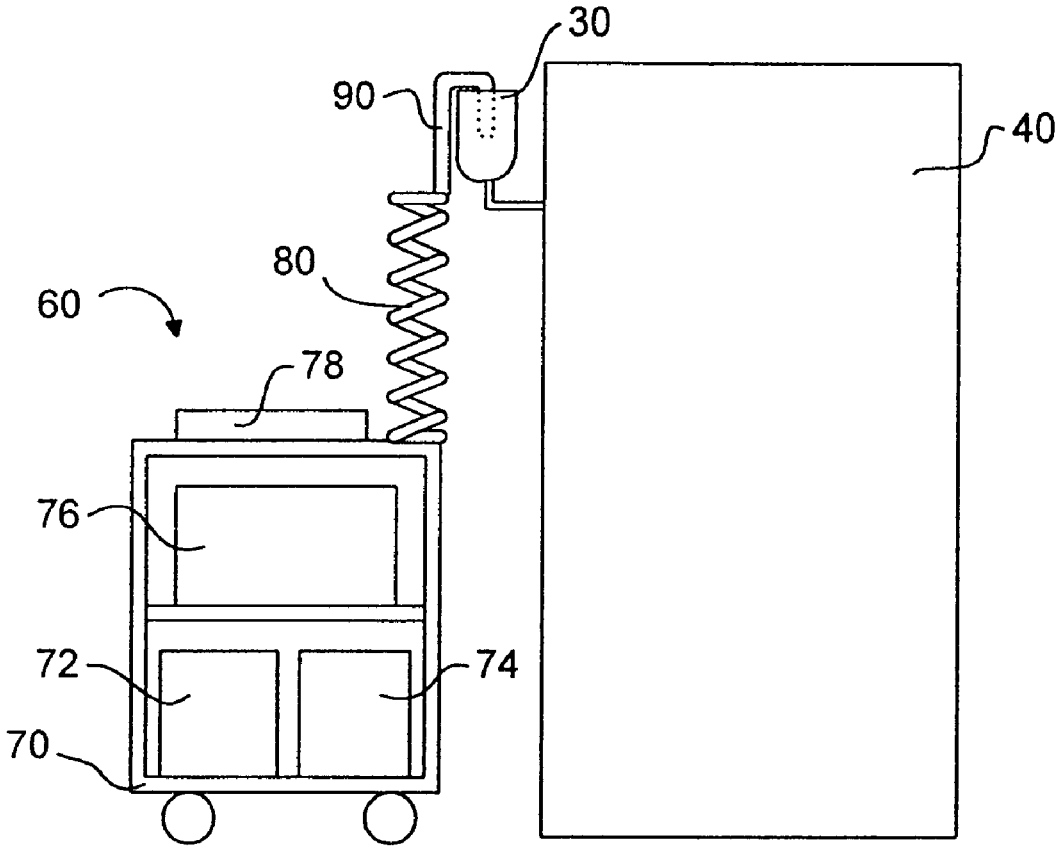
FIG. 2 is a front view illustrating a lubricant replenishing system in accordance with an exemplary aspect of the invention.

Referring now to the figures, several aspects of the present invention are presented. In FIG. 2, one example of a lubricant replenishing system 60 is shown. The lubricant replenishing system 60 includes a cart 70, which is able to hold and transport all of the system components. The system components may include a battery 72 so that a wire connection to a power supply is not required. The battery 72 may be coupled with a battery charger 74. This will allow for ease of recharging the battery 72 when it falls below a predetermined energy level. However, a wire connection to a power supply or AC line power may be utilized as an alternative to the battery 72 and is contemplated as falling within the scope of the present invention.

The battery 72 may provide energy to a pump 76 and a control module 78. The pump 76 may be used to control the flow of a lubricant from the replenishing system 60. The control module 78 may be adapted to control the pump 76 in selectively dispensing the lubricant into the machine 40. The control module 78 may further be adapted to show a status of the system 60, such as, the level of lubricant in a storage tank (not shown) associated with the system 60, the energy level of the battery 72, whether an error occurred in the system 60, and other such system indicators.

According to one exemplary aspect of the present invention, the storage tank utilized to contain the lubricant may comprise a sensing device to sense a level of the lubricant in the storage tank. Said sensing device may communicate the level to the control module 78 which may then indicate a status to an operator of the system 60.

The system 60 may also include a retractable tube 80 for directing the lubricant from the replenishing system 60 to the machine 40. This retractable feature will allow for easy and orderly storage of the tube 80 when it is not in use. This feature, as will be described in greater detail below, will also help prevent the tube 80 from becoming a tripping hazard or from becoming tangled in other tubes, hoses, wires, etc. A nozzle 90 may be coupled with said tube 80. The nozzle 90, as will be described in greater detail below, may be adapted or otherwise configured so as to securely attach to a lubricant reservoir 30 of a machine 40. By securing the nozzle 90 to the lubricant reservoir 30, the operator's hands will be free to operate the control module 78 or to perform other functions.

Figure 3A:
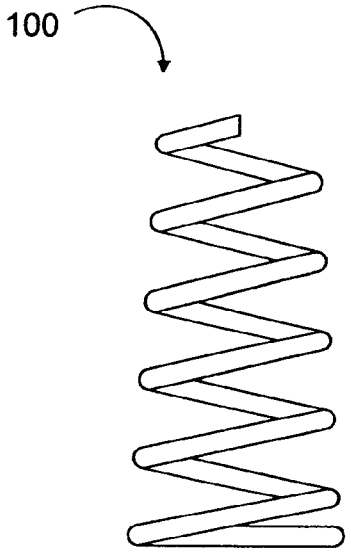
FIG. 3*a* is a front view illustrating a retractable tube in a generally extended position in accordance with an exemplary aspect of the invention.
Figure 3B:
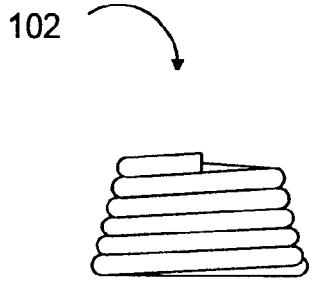
FIG. 3*b* is a front view illustrating a retractable tube in a generally retracted position in accordance with an exemplary aspect of the invention.
Figure 3C:
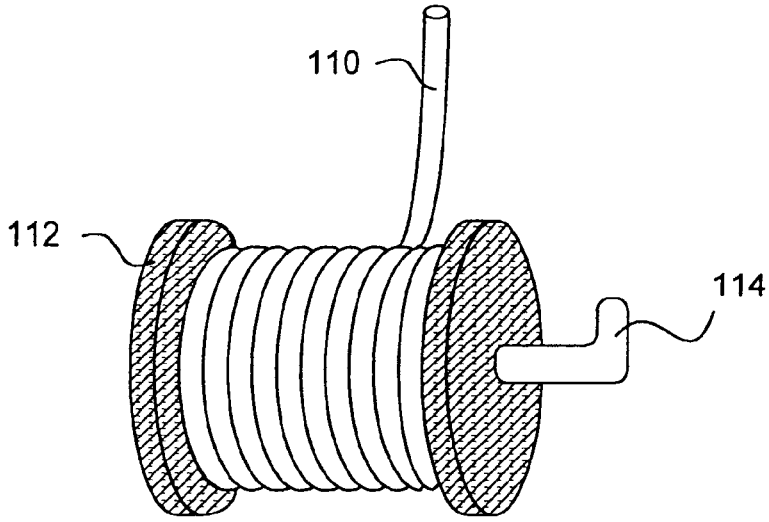
FIG. 3*c* is a perspective view illustrating a retractable tube in accordance with an exemplary aspect of the invention.

The retractable tube 80, as discussed above, may take a variety of shapes, for example, a coil 100, as illustrated in FIG. 3*a*. The coil-shaped tube 100 may be stretched to securely attach to a lubricant reservoir 30 of a machine 40 as illustrated. Said tube 100 may be biased so that when it is not stretched the tube will return to an initial state 102. as depicted in FIG. 3*b*. Alternatively, as in FIG. 3*c*, a tube 110 may be wound around a reel 112 when it is not in use. The winding may occur by way of turning a handle 1 14 manually, as depicted in FIG. 3*b*, or by way of a motor (not shown) or biased spring arrangement (not shown) which may be operated through the control module 78, for example. Therefore any shape tube that may be retracted or otherwise stored (manually, mechanically, or electrically) may be utilized and is contemplated as falling within the scope of the present invention.

Figure 4A:
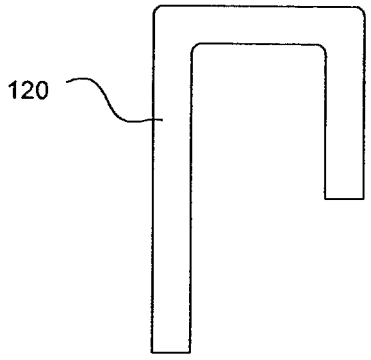
FIG. 4*a* is a side view illustrating a nozzle in accordance with an exemplary aspect of the invention.
Figure 4B:
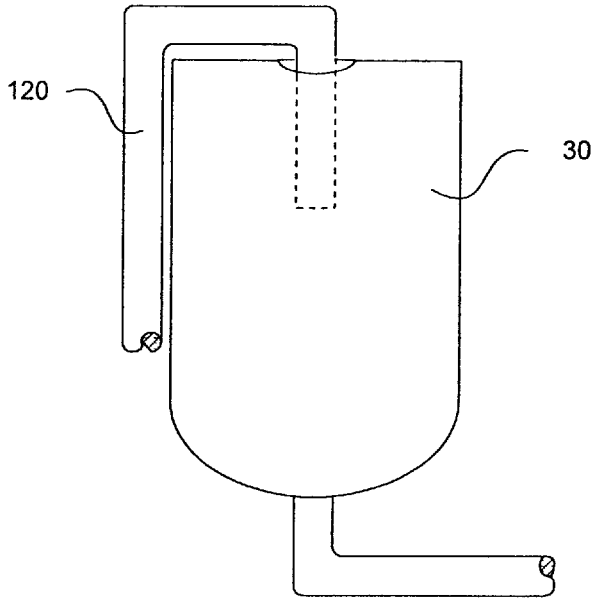
FIG. 4*b* is a side view illustrating the use of a nozzle with a lubricant reservoir in accordance with an exemplary aspect of the invention.

The nozzle 90, as discussed above, may be configured in a variety of ways to securely attach to the lubricant reservoir 30 of the machine 40. Turning now in detail to the figures, FIG. 4*a* illustrates an exemplary nozzle 120 according to the present invention. The hook-shaped configuration allows an operator to secure the nozzle 120 to the lubricant reservoir 30 and free his hands to operate the control module 78, for example. FIG. 4*b* illustrates an example of how the nozzle 120 in FIG. 4*a* may interact 30 with the lubricant reservoir 30.

Figure 4C:
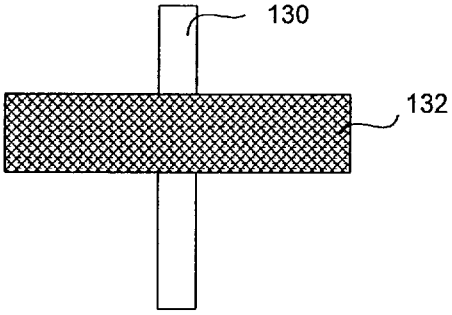
FIG. 4*c* is a side view illustrating a nozzle in accordance with an exemplary aspect of the invention.
Figure 4D:
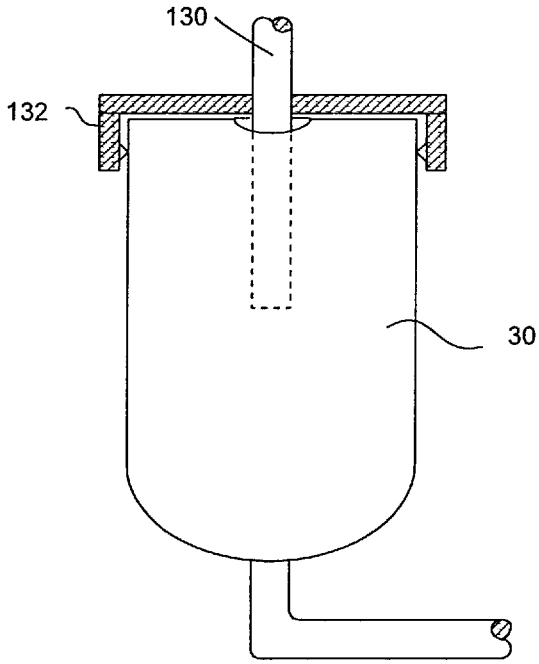
FIG. 4*d* is a side view illustrating the use of a nozzle with an lubricant reservoir in accordance with an exemplary aspect of the invention.

FIG. 4*c* illustrates another example of a nozzle 130 in accordance with the present invention. Here, the nozzle 130 is coupled with a cap 132. The cap 132 may be knurled to facilitate gripping. FIG. 4*c* illustrates a front view of the cap 132, while FIG. 4*d* illustrates a cross sectional view of the cap 132. This cross sectional view is shown to illustrate one exemplary manner in which the cap 132 may interact with the lubricant reservoir 30. The cap 132 is designed to secure to the top of the lubricant reservoir 30 and hold the nozzle 130 in place.

Figure 4E:
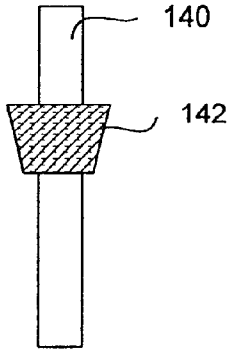
FIG. 4*e* is a side view illustrating a nozzle in accordance with an exemplary aspect of the invention.
Figure 4F:
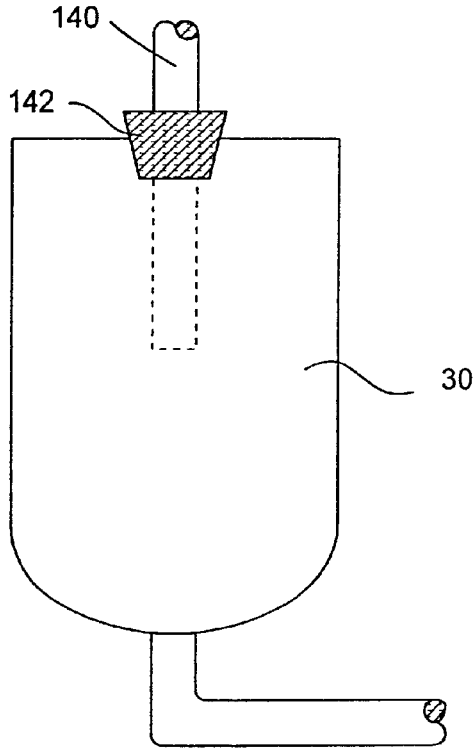
FIG. 4*f* is a side view illustrating the use of a nozzle with an lubricant reservoir in accordance with an exemplary aspect of the invention.

FIG. 4*e* illustrates yet another example of a nozzle 140 in accordance with the present invention. Here the nozzle 140 is coupled with a plug 142. The plug 142 is designed to snug into the opening (not shown) of the lubricant reservoir 30 to secure the nozzle 140 in place, as illustrated in FIG. 4*f*. Alternatively, however, any shape nozzle that may be adapted or otherwise configured to secure to the lubricant reservoir 30 may be utilized and is contemplated as falling within the scope of the present invention.

Figure 5:
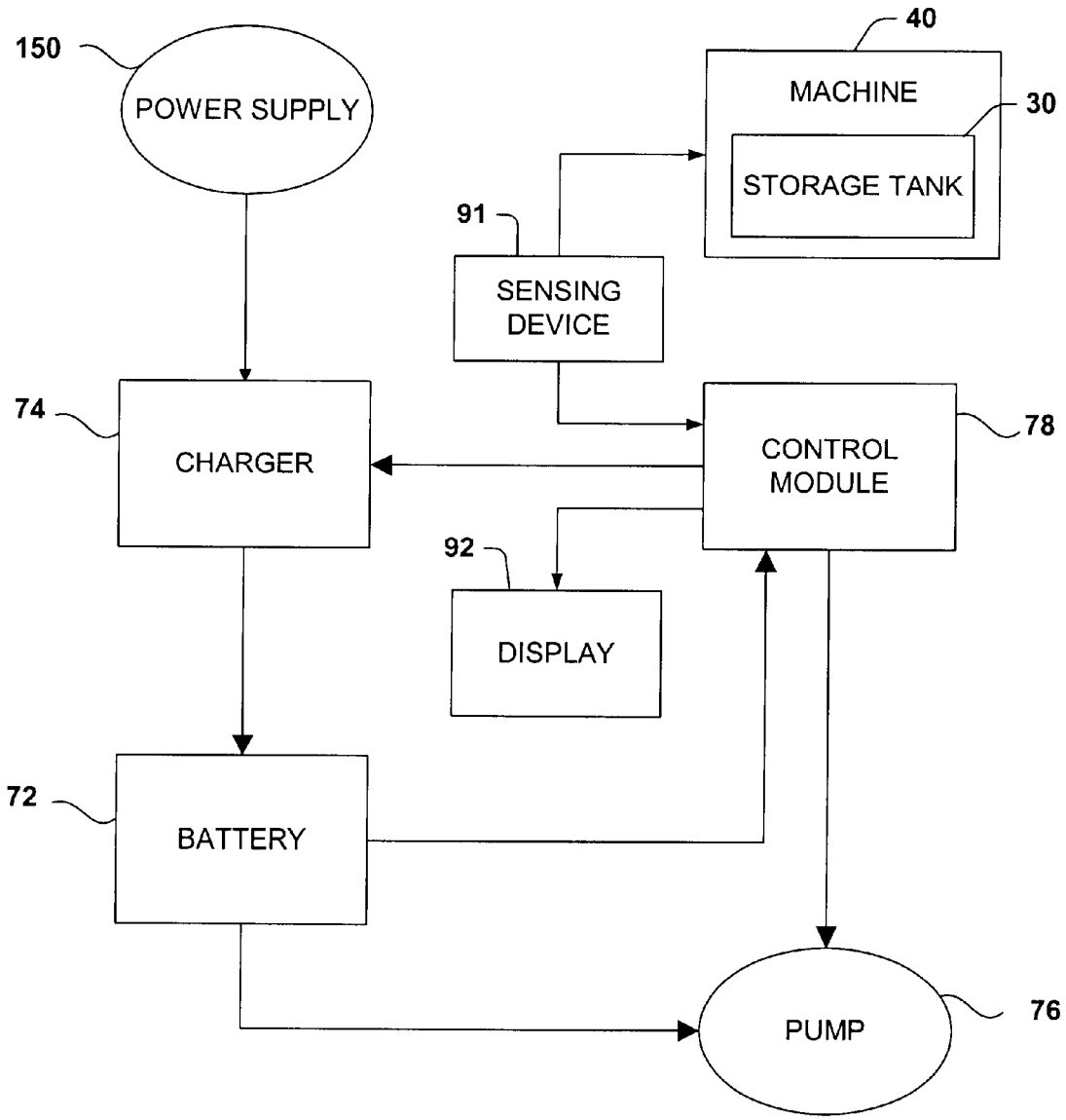
FIG. 5 is a block diagram of a lubricant replenishing system in accordance with one aspect of the present invention.

Referring now to FIG. 5, a block diagram illustrates one exemplary aspect of the present invention. The portable replenishing system 60 may include a control module 78 adapted to operate a pump 76 and a battery charger 74 in either a manual or automated mode, as will be discussed in greater detail below. The battery 72 powers the control module 78 and provides energy to the pump 76. When it becomes necessary to charge the battery 72, the battery charger 74 is coupled with a power supply 150, such as a 220 V outlet, and the charger 74 recharges the battery 72. The control module operationally couples to a sensing device 91 associated with a fluid storage tank 30 associated with a machine 40 to communicate a status thereof to the control module 78. In addition, the control module 78 is coupled to a display 92 to provide an indication of the status of the storage tank 30 as indicated by the sensing device 91.

The device remains activated whenever power is applied and provides an indication to the operator only when the low lubricant level is detected. The lubricant level may also be checked manually by way of a visual inspection. If the lubricant level has fallen below the predetermined level (YES), the storage tank is refilled with lubricant (step 168). If, however, the lubricant level is sufficient (NO), the lubricant replenishing system 60 is moved to a machine 40 (step 170). The next determination to be made is whether the lubricant level of the machine reservoir 30 has fallen below a predetermined level (step 172). A sensing device 91 coupled with the machine 40 may signal to the control module 40 as illustrated in FIG. 5 or to an operator when the lubricant has fallen below the predetermined level. The control module 78 is coupled to a display 92 to provide an indication of the storage tank status. Alternatively, the lubricant reservoir 30 may be made of clear plastic so that the lubricant level may be easily detected by a quick visual inspection. If this answer is negative (NO), the lubricant reservoir 30 of the machine 40 does not need to be replenished and the process stops (step 180). However, if the lubricant reservoir 30 does need replenishment (YES), an operator secures a hook shaped nozzle 120, or any other nozzle as described above, to the lubricant reservoir 30 (step 174) and operates the pump 76 (step 176) to begin replenishment of the lubricant for that machine 40. When the lubricant reservoir 30 has reached its fill level, the pump 76 is stopped and the nozzle 120 is detached from the lubricant reservoir 30 (step 178). The machine 40 is now replenished and the process stops (step 180).

Figure 7A:
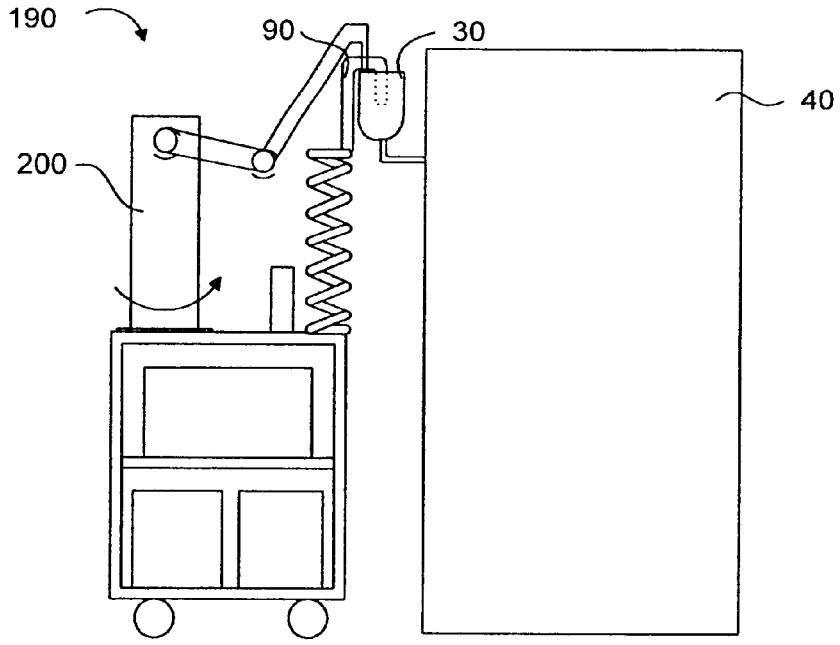
FIG. 7*a* is a front view illustrating a method of replenishing a lubricant with the replenishing system in a generally employed position in accordance with an exemplary aspect of the present invention.
Figure 7B:
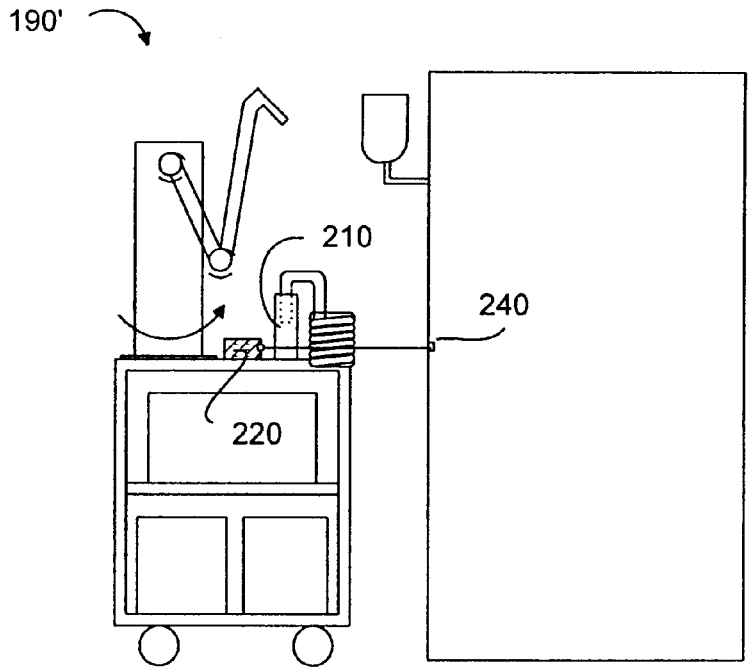
FIG. 7*b* is a front view illustrating a method of replenishing a lubricant with the replenishing system in a generally stored position in accordance with an exemplary aspect of the present invention

According to another aspect of the invention, the lubricant replenishing system may be automated and will be discussed in conjunction with FIGS. 7*a* and 7*b*, respectively. The system, as illustrated in FIG. 7*a* and designated at reference numeral 190, comprises a robot 200 operable to secure and detach the nozzle 90 to and from the lubricant reservoir 30 of the machine 40. The robot 200 may be further operable to store the tube 80 and nozzle 90 assembly in a container 210 when the system 130 is not in use, as depicted in FIG. 7*b*. The automated lubricant replenishing system 190 may further comprise a sensing device (not shown) associated with the machine 40 or the system 190 and operable to sense a level of lubricant in the lubricant reservoir 30 and to communicate said level to the control module (not shown). The control module may be attached to the portable replenishment system 190 or it may operate at a central station to control the operation of the replenishment system 190 via a wireless data link. The system 190 may also comprise a sensing device 220 operable to determine the system's position in relation to the machine 40. The sensing device 220 may function by emitting a beam to locate an indicia 240 on the machine, as illustrated in FIG. 7*b*. The sensing device 220 will prevent the robot 200 from operating the system 190 when the it is not in the proper position.

According to another aspect of the present invention, a method of using the lubricant replenishing system 60 to replenish multiple machines 40, 250, 260, is disclosed and will be discussed in conjunction with FIGS. 8, 9*a* and 9*b*, respectively.

Figure 8:
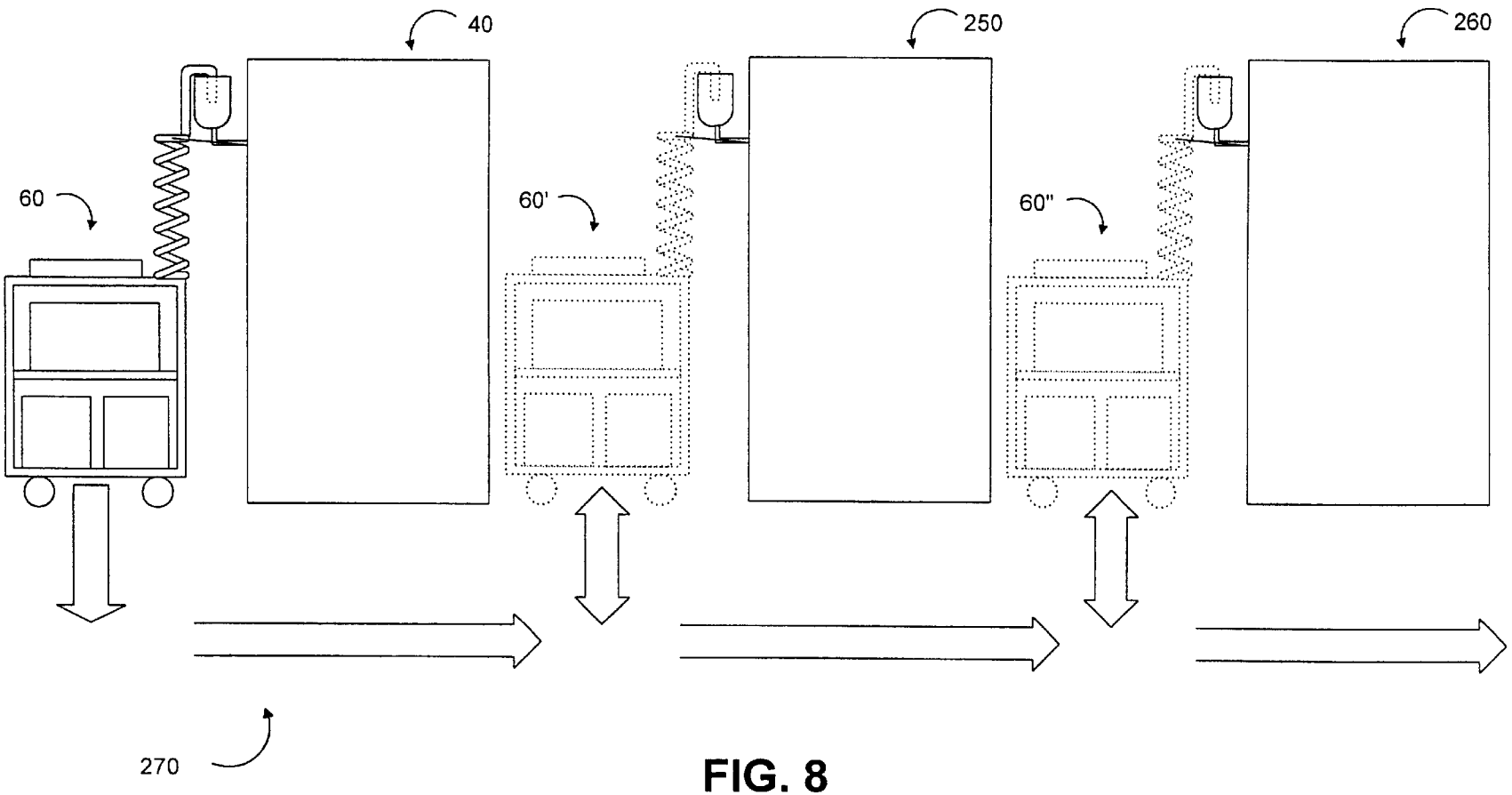
FIG. 8 is a front view illustrating an automated system and method of replenishing a lubricant in accordance with the present invention.

FIG. 8 illustrates one exemplary configuration of industrial machines 40, 250, 260 on a shop floor and how the lubricant replenishing system 60 may interact with such a configuration. The lubricant replenishing system 60 replenishes the first machine 40. The system 60' then moves to the next machine 250 for replenishment. Again, the system 60' moves to the next machine 260 to repeat the process. The arrows 270 indicate an exemplary path the system may follow. This continues until all lubricant reservoirs of the machines 40, 250, 260 have been replenished.

Figure 9A:
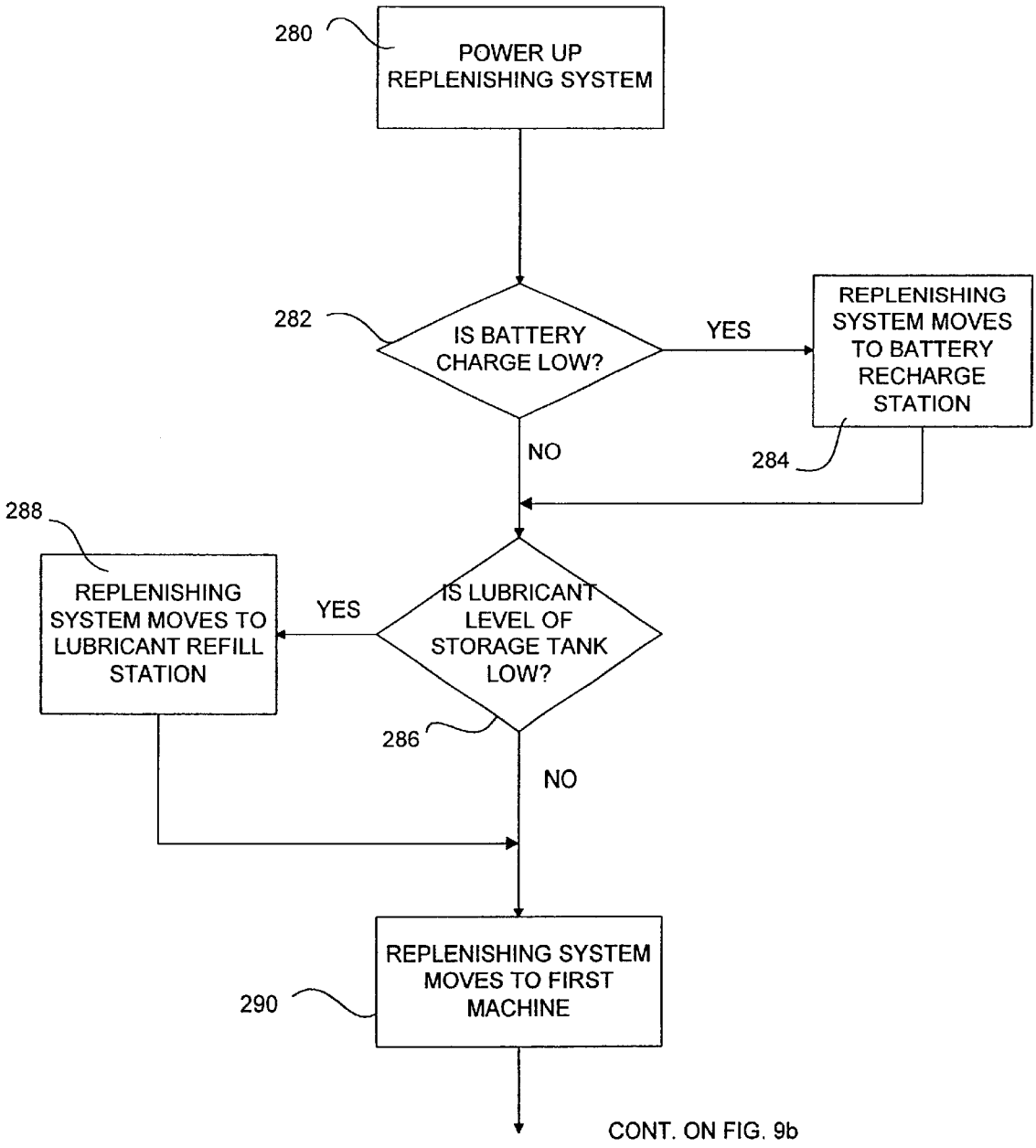
FIG. 9*a* is a flow chart illustrating a lubricant replenishing method in accordance with an exemplary aspect of the invention.
Figure 9B:
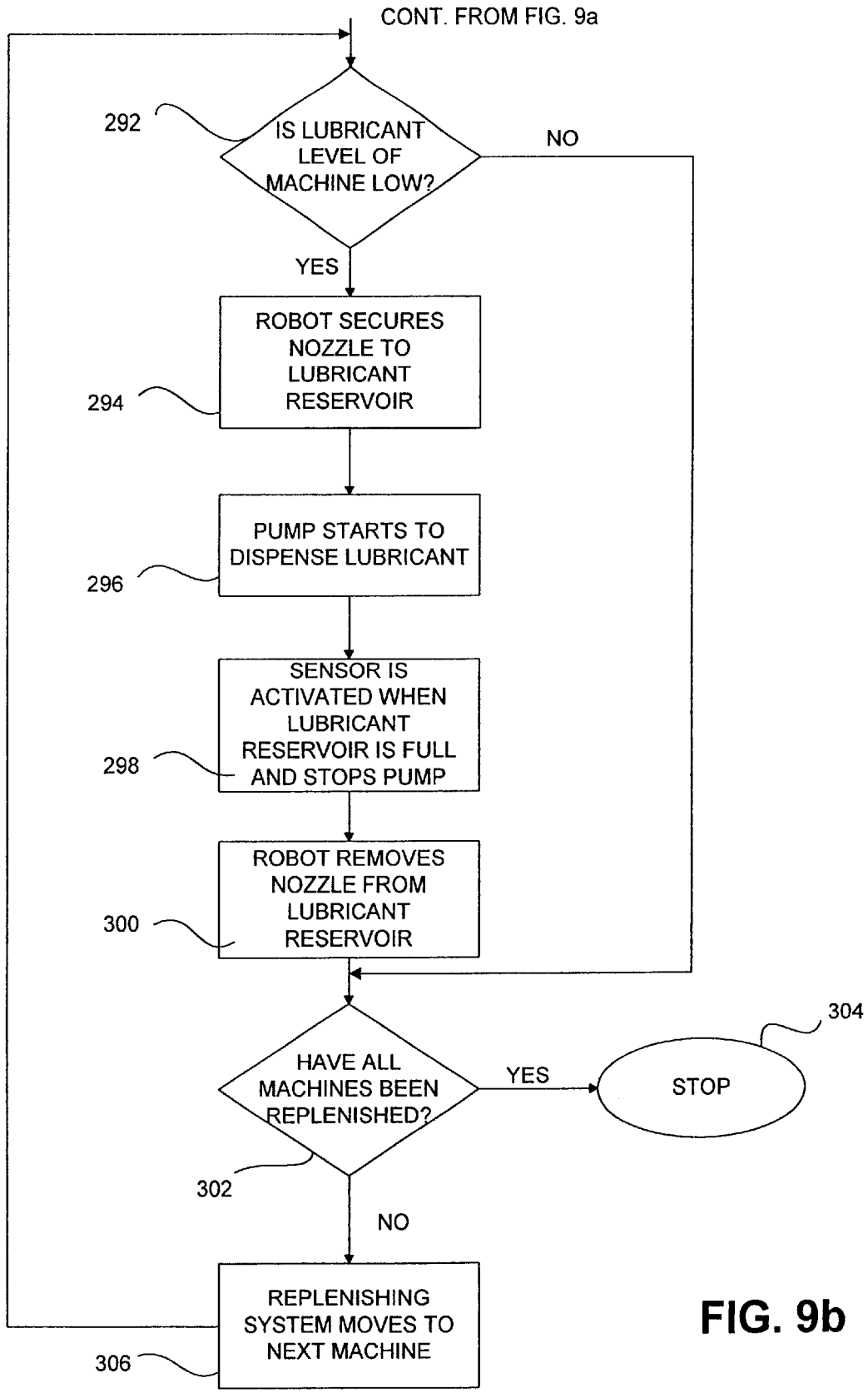
FIG. 9*b* is a flow chart illustrating a lubricant replenishing method in accordance with an exemplary aspect of the invention.

FIGS. 9*a* and 9*b* illustrate the above method in further detail. Turning now to FIG. 9*a*, a flowchart illustrates an exemplary method for replenishing lubricant in multiple industrial machines. The method begins at step 280 in which the replenishing system 60 is powered up. Next, the control module 78 determines the energy level of the battery 72 (step 282). This may also be determined manually. If the energy level of the battery 72 is low (YES). the system 60 is sent to a battery recharge station (step 284). Here the battery charger 74 is connected to a power supply 150, the battery 72 is fully charged and the system 60 proceeds to the next step. If the energy level of the battery 72 is not low (NO), the control module 78 then determines the lubricant level of the storage tank (step 286). Again, this may also be determined manually. If the lubricant level of the storage tank is below a predetermined level (YES), the system 60 is sent to a lubricant refill station. The level of the storage tank may be determined in similar methods discussed above. If the lubricant level of the storage tank is not low (NO), the system 60 proceeds to the next step.

After initial system checks have been performed, the system 60 moves to a first machine (step 290). The lubricant level of the lubricant reservoir 30 is checked, manually or through a sensing device (step 292). If the lubricant level of the lubricant reservoir 30 is below a predetermined level (YES), the nozzle 90 is secured to the lubricant reservoir 30 by the robot 200 (step 294). The pump 76 is then activated and lubricant is dispensed into the lubricant reservoir 30 (step 296). A sensing device detects when the reservoir 30 is full, sends a message to the control module 78, and the pump 76 is deactivated (step 298). Alternatively, the pump 76 may be manually deactivated when a visual determination of the lubricant reservoir 30 is performed. The nozzle 90 is then removed from the lubricant reservoir 30 (step 300).

When the preceding steps have been completed, or if the lubricant reservoir 30 of said first machine 40 does not need replenishment (NO), the control module 78 determines if there are other machines that need replenishment (step 302). If all machines have been checked and/or replenished (YES), the process stops (step 304). If additional machines need replenishment (NO), the above method is repeated until all machines have been replenished (step 306).

In accordance with another exemplary aspect of the present invention, the cart 70 which may self-propel the system 60 from machine to machine may be controlled in a variety of ways. The system 60 may be position and navigated through use of the global positioning system (GPS) technology. Alternatively, the system 60 may comprise an on-board computer that causes the system 60 to follow a desired path. These technologies will enable the system 60 to track a preset path without the need for tracks or wires. However, tracks and wires may be utilized to position and navigate the lubricant replenishing system 60 and still be contemplated as falling within the scope of the present invention.

The systems and methods of the present invention can be used to replenish any type of lubricant in any type of industrial machine. For instance, the lubricant may be oil-based, water-based, fuel-based, or any other type of lubricant. The machine may be a trim and form machine, a mill, a lathe, an injection molding machine, a machine utilized in assembly operations, or any other type of industrial machine.

Although the invention has been shown and described with respect to certain embodiment or embodiments, equivalent alterations and modifications will occur to others skilled in the art upon the reading and understanding of this specification and the annexed drawings. In particular regard to the various functions performed by the above described components (systems, devices, assemblies, etc.), the terms used to describe such components are intended to correspond, unless otherwise indicated, to any component which performs the specified function of the described component (i.e., that is functionally equivalent), even though not structurally equivalent to the disclosed structure that performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application. Furthermore, to the extent that the term "includes" is used in either the detailed description or the claims, such term is intended to be inclusive in a manner similar to the term "comprising".

What is claimed is:

1. A replenishment system for replenishing a vanishing oil used in semiconductor processing in combination with an integrated circuit trim and form machine having a lubricant reservoir associated therewith, and wherein the lubricant reservoir is configured to contain the vanishing oil therein for use in trim and form operations associated therewith, comprising:

a storage tank to contain the vanishing oil for dispensing therefrom;

a pump operable to dispense the vanishing oil from the storage tank into the lubricant reservoir of the trim and form machine;

a retractable tube coupled with the pump and operable to direct the vanishing oil from the storage tank to the lubricant reservoir;

a nozzle associated with the retractable tube, wherein the nozzle is configured to secure to the lubricant reservoir;

a control module adapted to control the pump in selectively dispensing the vanishing oil into the lubricant reservoir, wherein the control module further communicates with a sensing device associated with the lubricant reservoir to detect a level of the vanishing oil in the lubricant reservoir and control the selective dispensing of vanishing oil thereto; and a cart adapted to hold and to transport the storage tank, pump, retractable tube, nozzle, and control module.

2. The system of claim 1, further comprising a battery to provide energy to the pump and control module.

3. The system of claim 2, further comprising a battery charger coupled with the battery and operable to recharge the battery when the battery falls to a predetermined energy level.

4. The system of claim 3, wherein the control module controls the battery charger.

5. The system of claim 4, wherein the control module comprises a display to show a status of the battery.

6. The system of claim 5, wherein the retractable tube is coiled and biased to return to its original state.

7. The system of claim 1, wherein the nozzle is configured in a shape of a hook.

8. The system of claim 1, wherein the nozzle comprises a fastening or grasping mechanism to secure to the lubricant reservoir of the trim and form machine.

9. A method for filling or replenishing a vanishing oil in a trim and form machine used in semiconductor processing, comprising:

moving a portable replenishing system near the trim and form machine, wherein the trim and form machine comprises a lubricant reservoir and an associated sensing device, and wherein the sensing device is further operable to detect a level of vanishing oil in the lubricant reservoir;

securing a specially configured nozzle to the lubricant reservoir;

communicating the level of vanishing oil between the sensing device and a control module;

delivering an amount of vanishing oil from the portable replenishing system to the lubricant reservoir;

using the control module to automatically dispense and control an amount of vanishing oil delivered from the portable replenishing system to the lubricant reservoir, based, at least in part, on the communication with the sensing device;

using the control module to monitor the status of a battery associated with the portable replenishing system; and using the control module to recharge the battery when an energy level of the battery is low.

* * * * *

UNITED STATES PATENT AND TRADEMARK OFFICE

CERTIFICATE OF CORRECTION

Figure 6:
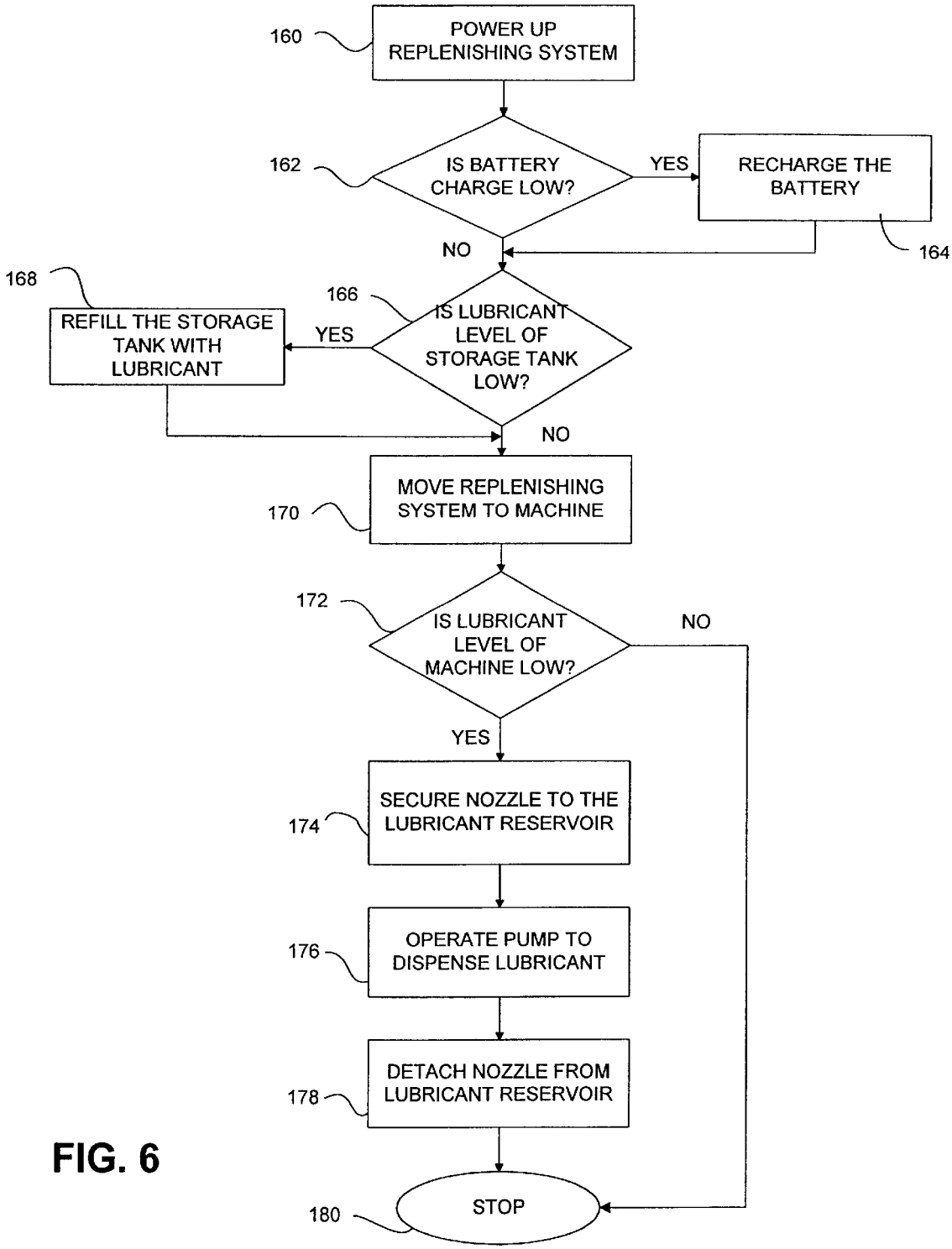
FIG. 6 is a flow chart illustrating a method of replenishing a lubricant in accordance with the present invention.

PATENT NO. : 6,390,157 B1 
DATED : May 21, 2002
INVENTOR(S) : Chalor Moogdaharn, Watcharin Pinlam and Youthachai Bupparit It is certified that error appears in the above-identified patent and that said Letters Patent is hereby corrected as shown below:

Column 6,
Line 13, please add the following paragraph:

-- FIG. 6 illustrates a method of replenishing a lubricant in an industrial machine, such as a trim and form machine 40, utilizing the present invention. The method begins at step 160 in which the lubricant replenishing system 60 is powered up. In step 162, the battery 72 is checked to determine if the charge is low. The charge may be determined by way of a status monitor on the control module 78 or an indicator light on the battery 72 itself. If the answer is in the affirmative (YES), the battery 72 is recharged (step 164) and the method proceeds to step 166. If the battery charge is not low (NO), the lubricant level of the storage tank 30 is checked to determine if the level has fallen below a predetermined level (step 166). Sensing devices may be utilized to determine whether the lubricant has fallen below such level. For example, as the lubricant level rises and falls in the storage tank 30, the dielectric effect of the lubricant changes the effective capacitance of a sensing capacitor which is detected by electronic circuitry coupled to a sensor --.

Signed and Sealed this

Twelfth Day of November, 2002

*Attest:*

*Attesting Officer*

JAMES E. ROGAN
*Director of the United States Patent and Trademark Office*